US005123894A

United States Patent [19]

Bergeman et al.

[11] Patent Number: 5,123,894

[45] Date of Patent: Jun. 23, 1992

[54] PAPER GUIDE AND STACKING APPARATUS FOR COLLECTING FAN FOLD PAPER FOR A PRINTER OR THE LIKE

[75] Inventors: Joseph R. Bergeman, Boise, Id.; Ray D. Humphrey, Jr., Smyrna, Ga.

[73] Assignee: Hewlett-Packard Company, Palo Alto, Calif.

[21] Appl. No.: 694,625

[22] Filed: May 2, 1991

[51] Int. Cl.[5] ..... B31B 1/10

[52] U.S. Cl. ..... 493/410; 400/613.2; 493/448

[58] Field of Search ..... 400/611, 619, 613, 613.2, 400/613.3; 211/50, 51; 226/200; 271/207, 220, 223, 224; 493/413, 460, 461, 410

[56] References Cited

U.S. PATENT DOCUMENTS

| | | | |
|---|---|---|---|
| 2,016,539 | 10/1935 | Brenn | 493/410 |
| 2,779,450 | 1/1957 | Mecum et al. | 493/410 |
| 3,514,096 | 5/1970 | Muller | 493/413 |
| 4,054,283 | 10/1977 | Rayfield | 493/413 |
| 4,265,444 | 5/1981 | Berglund | 271/207 |

*Primary Examiner*—Edgar S. Burr
*Assistant Examiner*—Lynn Hendrickson

[57] ABSTRACT

A paper guide and stacking apparatus for fan fold or Z-fold paper and useful with a printer of the type having an output paper collection tray or bin positioned a predetermined vertical distance from an exit port and sound shroud connected to the printer. This novel apparatus is characterized by the use of a pair of flexible front straps which are positioned on one side of a vertical paper path extending from the printer exit port and sound shroud to the paper collection tray, and also by the use of a single flexible back strap which is positioned on the other side of the paper path and centered between the two front straps. These straps make physical contact with each side of the moving paper in such a manner as to force each successive sheet of fan fold paper alternately toward opposite sides of the output paper tray. Advantageously, the upper ends of the plastic straps may be secured by magnets to the walls of sound shroud or printer housing, and these straps are preferably made of a thin plastic material having a certain degree of stiffness sufficient to gently force each successive sheet at an angled direction into opposite sides of the output paper collection tray. This force may be varied by slightly changing the length of the plastic straps and thereby slightly modifying the inwardly convex contours of each of the front and back straps. The vertical centering of the back strap with respect to the two front straps prevents the guided sheets from twisting in the moving paper path, thereby further enhancing the uniformity of paper stacking.

5 Claims, 2 Drawing Sheets

PAPER GUIDE AND STACKING APPARATUS FOR COLLECTING FAN FOLD PAPER FOR A PRINTER OR THE LIKE

TECHNICAL FIELD

This invention relates generally to output paper collection devices for printers, plotters, and the like, and more particularly to such devices that guide Z-fold or fan fold tractor paper in such a manner as to ensure uniform stacking thereof.

BACKGROUND ART

Fan fold or Z-fold tractor paper which has been used in a variety of printer applications over the past several years has a certain initial and inherent memory before being fed through a printer. If this memory could somehow be retained at the output of the printer, it would tend to correctly and uniformly refold and stack the paper in an output paper tray or bin. Unfortunately, this inherent memory is, to a significant degree, lost when the paper is processed through the printer. This is a result of the processed paper being exposed to heat and pressure within the printer and to inertia therein as a result of the paper being subjected to periodic variations in paper speed.

Because of the latter phenomenon, the paper develops a tendency to fold in an output paper tray or bin in a direction opposite to the direction of memory or bias which was initially inherent in the paper upon receipt from the manufacturer. This improper folding is caused by the fact that the paper tends to drop straight down vertically into an output paper tray or bin instead of being projected from a paper exit port of the printer at a desired angle toward one side of the output paper tray. This vertical dropping motion will in turn frequently cause the paper to buckle up in the output tray or bin and become extremely resistant to uniform refolding and stacking. It is the solution to this problem to which the present invention is directed.

DISCLOSURE OF INVENTION

In accordance the present invention, it has been discovered that the above buckling and resistance to uniform stacking of paper at the output of a printer can be avoided by the use of a pair of flexible contoured paper guides or straps on one side of the output paper path and by the use of a single flexible contoured guide or strap on the other side of the paper path which is vertically aligned between the pair of straps. These front and back contoured straps are positioned on each side of paper exiting a printer and passing therebetween so that the Z-fold tractor paper leaving the printer is guided by the front straps in an angled direction toward one side of an output paper tray and then subsequently guided toward an opposite side of the tray by the back strap. This control over paper motion and direction causes neat and uniform stacking of the Z-fold or fan fold paper in an output paper tray or bin.

These front and back flexible straps are preferably made of a thin plastic material having a certain amount of stiffness therein and having gently curved surfaces which are convex in the direction of the paper passing therebetween. These front and back straps come into direct contact with the paper at a predetermined plane or region located between the exit port of the printer and the output paper tray. In this manner, the flexible front and back straps gently nudge and force each successive fan-fold sheet of tractor paper alternatively into opposite sides or corners of the output paper tray and in a direction which causes these sheets to fold smoothly and uniformly one on top of another.

Advantageously, the back flexible strap is centered between the two front straps so that the paper is prevented from twisting in the vertical plane of paper travel extending between the exit port or sound shroud of the printer and the output paper tray, thereby further ensuring good paper stacking uniformity.

Accordingly, the general purpose and principal object of the present invention is to provide a new and improved paper stacking apparatus and method for use with fan fold or Z-fold paper which is operative to ensure the uniformity of paper refolding and stacking in an output paper collection tray or bin.

Another object of this invention is to provide a new and improved paper guide and stacking apparatus of the type described which is elegantly simple in its design, economical in construction and reliable in operation.

Another object of this invention is to provide a new and improved paper guide and stacking apparatus of the type described which may be readily retrofitted onto existing printers and associated paper tray collection devices and the like.

Another object of this invention is &:o reduce the manpower required to rearrange and re-stack fan fold paper which has accumulated at the output of a printer.

A feature of this invention is the provision of a new and improved paper stacking method of operation which includes a process for stacking fan fold or Z-fold paper at the output of a printer. This process includes positioning contoured flexible straps on each side of a paper path leading from an output port of the printer, and feeding the paper between the straps and into an output paper collection tray. These flexible straps are correctly positioned to alternately urge each successive leading edge and trailing edge of each sheet of paper into front and back corners, respectively, of paper being stacked, thereby enhancing uniformity in the paper stacking process.

The above brief summary of the invention, together with its attendant objects and related advantages and novel features, will become more readily apparent in the following description of the accompanying drawings.

DETAILED DESCRIPTION OF THE PREFERRED EMBODIMENT

Figure 1:
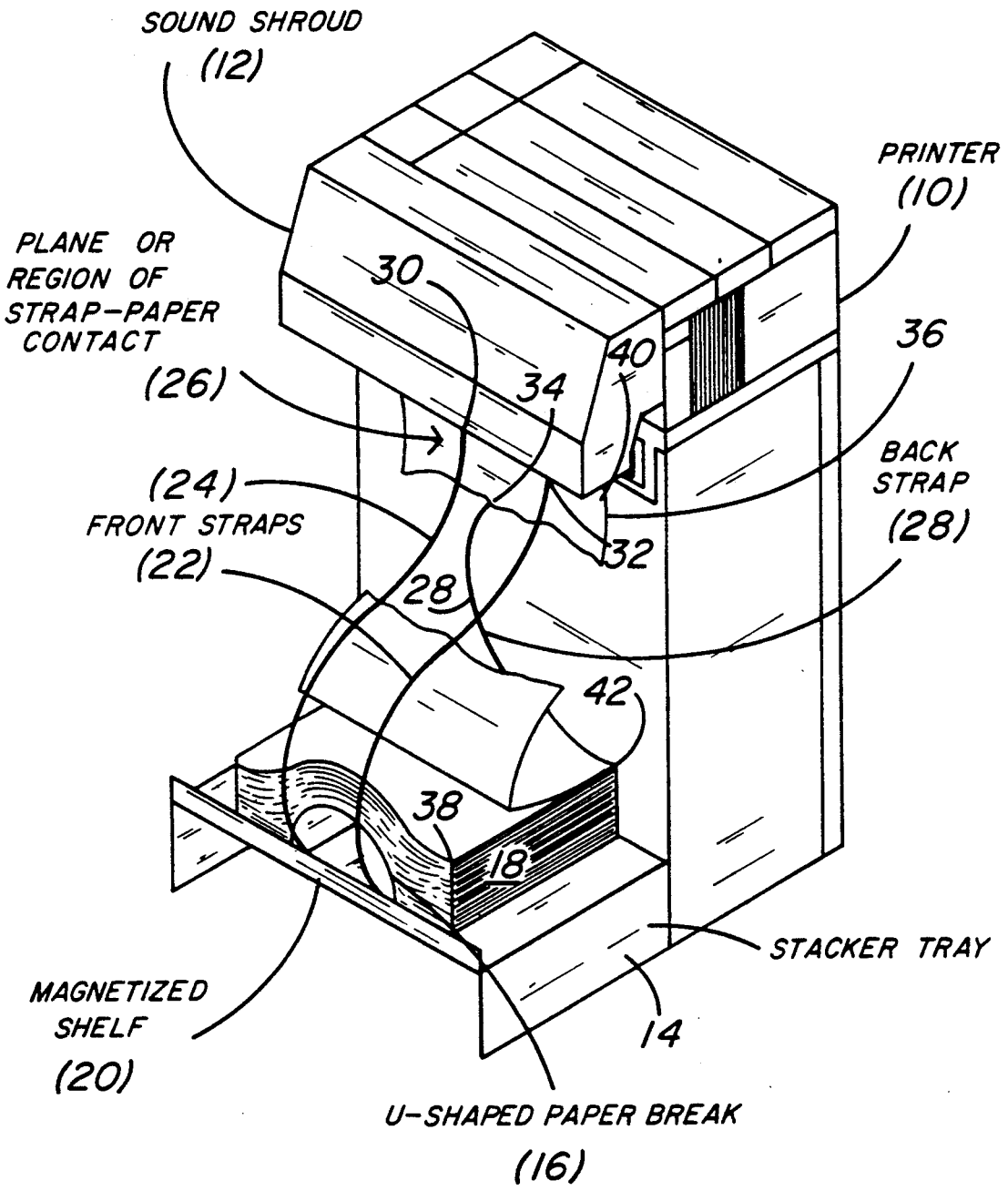
FIG. 1 is an isometric view showing the paper guide and stacking apparatus constructed in accordance with the present invention.

Referring now to FIG. 1, there is shown a stand alone printer 10 having an output sound shroud 12 positioned over and around the printer's paper exit port (not shown) and also positioned vertically above a paper stacker tray 14. The paper stacker tray 14 supports a U-shaped paper break member 16 having an upwardly facing convex surface useful to provide good weight distribution for and support to the fan fold paper 18 received thereon. The paper break member 16 also serves to compensate for the paper stack thickness variations from the edge to the center of the paper stack 18. The processing that occurs to the paper as it passes through the printer causes the pin feed holes (not shown) located in the paper 18 to deform. This deformation of the paper produces stack thickness variations from the edge to the center of the paper stack. The paper break member 16 corrects this problem by holding the center portion of the paper stack 18 so that the paper stack 18 will maintain a substantially uniform surface contour as the paper stacks up vertically as shown.

Figure 2A:
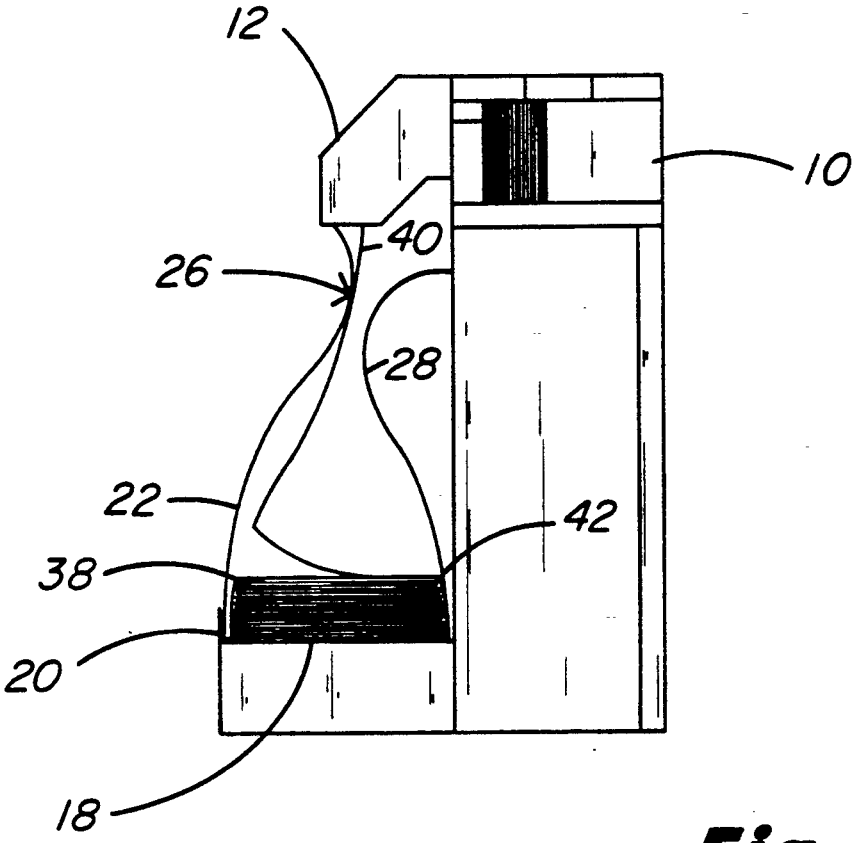
FIG. 2A is a cross-section view taken vertically between the two flexible plastic straps shown in FIG. 1 and with these straps secured in place on the lower magnetized shelf of the apparatus.
Figure 2B:
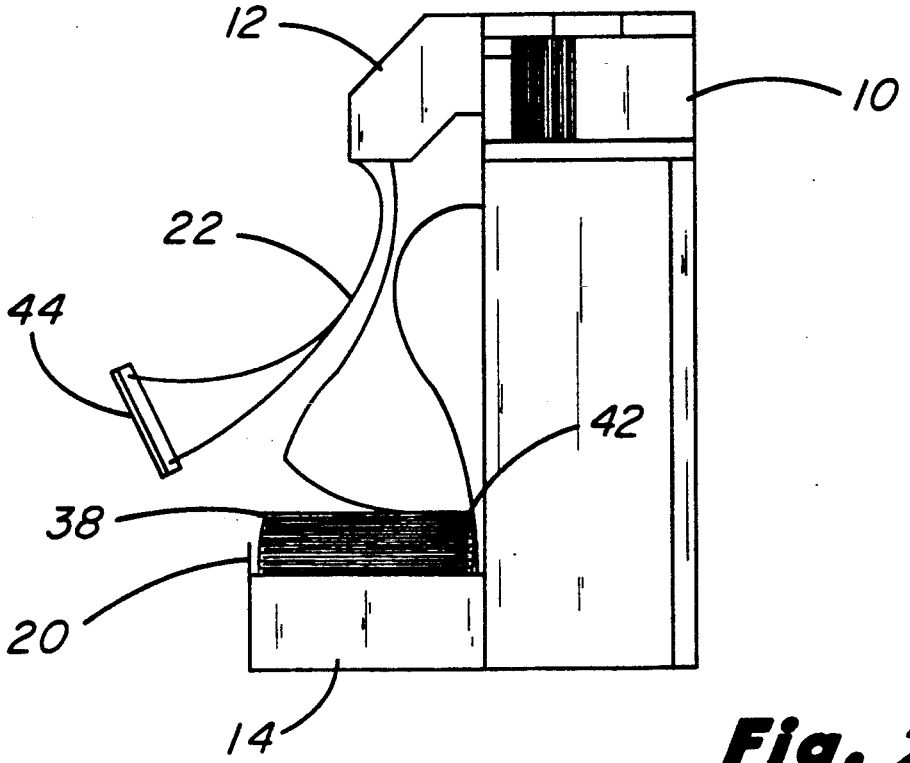
FIG. 2B is similar to FIG. 2A, and shows the plastic plate which is secured to the two front straps rotated 90° with respect to its orientation in FIG. 2A.

Referring now also to FIGS. 2A and 2B, a pair of front plastic guide straps 22 and 24 of the paper stacking apparatus are attached at the lower ends thereof to a plastic bracket 44. This plastic bracket 44 has a magnet (not shown) attached to it, and the lower paper tray ends of the plastic guide straps 22 and 24 are located and attached to the paper tray by attaching the magnetized bracket 44 to a front magnetized shelf 20. These front plastic guide straps 22 and 24 are preferably fabricated of a thin flexible plastic material having a sufficient degree of stiffness to provide a gentle urging and inwardly directed force against the fan fold paper shown and in the general area 26 of the downwardly moving paper. This is the area where the approximate maximum radius of curvature for these two front straps 22 and 24 as well as the back strap 28 makes direct physical contact with the fan fold paper.

Both the front straps 22 and 24 extend upwardly in the generally S-shaped contour shown to the two outside locations 30 and 32 on the front wall of the sound shroud 12, and the centrally positioned back strap 28 extends upwardly in the contour shown and is attached to the front wall of the printer housing 10. This connection is shown in more detail at the top end of the strap 28 in FIG. 2A. These front and back straps 22, 24, and 28 may be either permanently secured or temporarily secured by magnets (not shown) at each of these top ends of the three straps.

In operation of this paper stacking apparatus, the lower section or sheet 36 of the fan fold paper will be gently guided by the contact that the back strap 28 makes at location 34 with the back side of the paper sheet 36 to guide this sheet of paper 36 first in the direction of the corner 38 of the paper stack 18 and then subsequently into the front edge or corner 38 of the stack of paper 18. Then, as the fan fold paper continues its downward vertical movement toward the stack of fan fold sheets 18, the next section or sheet 40 of fan fold paper will be gently urged by surface contact with the front plastic straps 22 and 24 toward and into the back edge or corner 42 of the paper stack 18. This motion can be best seen with reference to FIG. 2A where the downwardly moving paper 40 eventually moves out of contact with the curved surface of the back strap 28 and then into direct contact with the two front straps at point 26 where the two front straps 22 and 24 will now force the downwardly moving paper toward the back edge 42 of the paper stack 18.

Referring again to FIGS. 2A and 2B, the lower ends of the two flexible straps 22 and 24 are secured to the ends of the narrow plate or bracket member 44 which is adapted to be magnetically attracted to the lower front magnetized shelf 20 in the orientation shown in FIG. 2A. However, in FIG. 2B the rectangularly shaped bracket 44 has been removed from the magnetized shelf 20 and rotated 90° in orientation. As previously noted, the plate or bracket 44 may itself have a magnetized metal therein or thereon so that it may be temporarily affixed to a surface of the sound shroud 12 when the stacked sheets 18 are being removed from the paper tray 14.

In a paper guide and stacking apparatus of the type shown in FIGS. 1 and 2 which has been actually built and successfully tested, the distance from the sound shroud 12 to the stacker tray 14 is on the order of about thirty-two (32) inches. The front and back plastic straps 22, 24, and 28 were cut from a polyethylene sheet of plastic material and of a thickness of about 0.6 millimeters and to a length of about thirty-five (35) inches. These dimensions give a desired degree of stiffness and flexibility to these straps and enable them to guide the paper in the manner described above into the uniformly arranged paper stack 18.

Various modifications may be made in and to the above described embodiment without departing from the spirit and scope of this invention. For example, when using larger sheets of paper it might be desirable to increase the number of guide straps used in order to adequately cover a larger surface area of the moving paper, or it might be desirable to increase the thickness and stiffness of the flexible guide straps for heavier papers. In addition, the top ends of the three flexible straps 22, 24, and 28 may be moved around, if desired, to various locations on the sound shroud 12 and the printer housing 10, respectively, in order to vary the radius of curvature and general overall contour of these straps. This modification of operation may be easily accomplished by the use of magnets affixed to the top ends of these three straps. Also, the top end of the back strap 28 may be attached to a chosen location on the sound shroud 12 instead of the printer housing 10 as shown in FIGS. 2A and 2B.

Accordingly, these and other similar design modifications are within the scope of the following appended claims, and the invention defined in these claims may be used in many different types of fan fold paper processing apparatus wherein the output paper stacking of the fan fold paper experiences the problem described above with respect to paper memory loss.

We claim:

1. A paper guide and stacking apparatus for uniformly stacking fan fold or Z-fold paper in an output paper collection tray of a printer consisting of a pair of flexible front straps positioned on one side of a vertical paper path extending from a printer exit port to said paper collection tray and a flexible back strap positioned on the other side of said vertical paper path and vertically positioned between said pair of front straps, said front and back straps being contoured inwardly toward each side of said paper path towards a region where said front and back straps each make physical contact with the paper passing therebetween to force each successive sheet or section of fan fold paper alternately toward opposite sides of said paper tray.

2. The apparatus defined in claim 1 wherein upper ends of said front and back straps are each secured to a printer housing member adjacent to said printer paper exit port and are made of a tin plastic material having a stiffness sufficient to force each successive sheet passing between said straps in an angled direction alternately towards opposite sides of said output paper tray.

3. The apparatus defined in claim 2 wherein both said front and back straps make direct physical contact with said fan fold paper at the approximate maximum radius of curvature of said straps, thereby preventing the guided sheets from twisting in the vertical plane between said paper exit port and paper tray and further ensuring the uniformity of paper stacking in said output paper tray.

4. A method for stacking fan fold or Z-fold paper at the output of a printer including steps of positioning three contoured flexible straps such that two of said straps are on one side of the paper and the third strap is on the other side of the paper and vertically positioned between the two straps on the one side of the paper leading from an output port of said printer, and feeding said paper between and in direct physical contact with said straps and into an output paper collection, said straps alternately urging each successive leading edge and trailing edge of each sheet of paper into front and back corners of the paper collection tray, thereby enhancing uniformity in the placement of paper in the paper collection tray.

5. The method defined in claim 4 which includes positioning said straps at their lower ends on each side of an area on which sheets of fan fold paper are to be accumulated.

* * * * *